US010474182B2

(12) United States Patent
Livolsi

(10) Patent No.: US 10,474,182 B2
(45) Date of Patent: Nov. 12, 2019

(54) ROTARY CONTROLLER LOCKING CAP, METHOD OF USE, AND ROTARY CONTROLLER LOCKING CAP KIT

(71) Applicant: LOKNOB LLC, Oswego, NY (US)

(72) Inventor: Anthony Livolsi, Oswego, NY (US)

(73) Assignee: LOKNOB LLC, Oswego, NY (US)

( * ) Notice: Subject to any disclaimer, the term of this patent is extended or adjusted under 35 U.S.C. 154(b) by 178 days.

(21) Appl. No.: 15/596,668

(22) Filed: May 16, 2017

(65) Prior Publication Data

US 2018/0335797 A1 Nov. 22, 2018

(51) Int. Cl.

| | |
|---|---|
| ***G05G 5/00*** | (2006.01) |
| ***H01C 10/32*** | (2006.01) |
| *G05G 1/08* | (2006.01) |

(52) U.S. Cl.

CPC ..... *G05G 5/005* (2013.01); *H01C 10/32* (2013.01); *G05G 1/08* (2013.01)

(58) Field of Classification Search

CPC ..... G05G 5/005; H01C 10/32; H01H 19/14
See application file for complete search history.

(56) References Cited

U.S. PATENT DOCUMENTS

| | | | | |
|---|---|---|---|---|
| 4,154,125 | A * | 5/1979 | Frank | G05G 1/10 200/336 |
| 4,733,035 | A * | 3/1988 | Ohashi | H01H 13/62 200/43.18 |
| 4,866,219 | A * | 9/1989 | Riding | G01D 5/25 200/4 |
| 5,513,831 | A * | 5/1996 | Seward | F16K 35/027 192/95 |
| D440,948 | S * | 4/2001 | Bianco, Sr. | D13/173 |
| 9,817,430 | B2 * | 11/2017 | Messadek | G10H 1/32 |
| 2014/0237790 | A1 * | 8/2014 | Messadek | G05G 5/005 29/401.1 |
| 2015/0346759 | A1 * | 12/2015 | Messadek | G10H 1/32 74/558.5 |

* cited by examiner

*Primary Examiner* — Kyung S Lee
(74) *Attorney, Agent, or Firm* — Greenblum & Bernstein, P.L.C.

(57) ABSTRACT

A rotary controller locking cap including a cap body having a longitudinal axis, a bore extending partially through the cap body along the longitudinal axis such that the cap body has an opening on a first side and is closed on an opposite second side, and an internally threaded portion arranged in the bore at least at the opening. The internally threaded portion is structured and arranged for threaded engagement with a threaded collar of a rotary controller. The bore is structured and arranged to accommodate an output shaft of the rotary controller therein while not contacting the output shaft when the cap body is engaged with the threaded collar. The cap body when engaged with the threaded collar is operable to preclude adjustability of the output shaft of the rotary controller.

20 Claims, 18 Drawing Sheets

ROTARY CONTROLLER LOCKING CAP, METHOD OF USE, AND ROTARY CONTROLLER LOCKING CAP KIT

BACKGROUND OF THE DISCLOSURE

1. Field of the Disclosure

This disclosure relates to a control mechanisms having angularly adjustable shafts, and more particularly, relates to methods and devices and kits for precluding adjustability of an angularly adjustable control mechanism (e.g., a potentiometer or rotary encoder).

2. Description of the Related Art

One type of rotary controller is a potentiometer. A potentiometer is a variable resistor or rheostat. Potentiometers are commonly used to control electrical devices, such as volume and other parameters (e.g., tone, mix, balance, time, drive, boost, etc.) on audio equipment (e.g., amplifiers, instruments, effects devices (e.g., stompboxes)). In the case of audio equipment, potentiometers may be used to adjust the level of analog signals present in the various electronic circuits in the device.

Potentiometers may comprise a resistive element, a sliding contact (wiper) that moves along the element, making electrical contact with one part of it, electrical terminals, a housing containing the element and wiper, and an output shaft with which the wiper can be moved, e.g., from one end of the element to the other. Potentiometer output shafts may come in all different configurations, including for example, splined, D-shaped cross-section, hexagonal, or any other polygonal shape.

Another type of rotary control is a rotary encoder. A rotary encoder, also called a shaft encoder, is an electro-mechanical device that converts the angular position or motion of a shaft or axle to an analog or digital code. The output of absolute encoders indicates the current position of the shaft, making them angle transducers. The output of incremental encoders provides information about the motion or position of the shaft.

In many, if not most, potentiometers (or other rotary control) applications, the angular position of the output shaft is manually set by a user (e.g., to adjust a particular parameter). Additionally, in many applications, a number of potentiometers may be arranged on a device (e.g., a stompbox) in close proximity to one another. Once a desired setting (e.g., rotary or angular position) for a particular parameter is achieved, a user may wish for the angular position of the output shaft to remain in that desired position. For example, "perfected" settings for such knobs (which, of course may be subjective) typically take a long time to achieve. If the position of any potentiometer on any device is moved (for example, amongst a plurality of potentiometers of respective various stompbox devices arranged on a pedal board), the user (or perhaps their roadie or technician) will need to re-set that position to the desired position in order to attain the desired parameter setting (and, for example, its desired impact on the resulting tone of a musical instrument, e.g., guitar, connected to the effect device).

For example, musicians experience significant disruptions and inconveniences when potentiometer knobs (or other rotary controls) are accidentally bumped, for example, during transportation of audio equipment, e.g., to or from rehearsals or gigs, requiring re-setting and/or re-calibration of the equipment each time it is used.

Some minimal efforts have been directed in the past to address the problem inherent in adjustable potentiometer output shafts/knobs, namely that the potentiometer output shafts/knobs are easily knocked out of adjustment by incidental contact, and the inconvenience and frustration resulting therefrom.

Therefore, there is a need for an improved device and method for preventing inadvertent adjustments of rotary control (e.g., potentiometers or rotary encoder) output shafts/knobs.

SUMMARY OF THE EMBODIMENTS OF THE DISCLOSURE

Aspects of the present disclosure are directed to device for preventing inadvertent adjustments of rotary controller output shafts.

Aspects of the present disclosure are directed to a rotary controller locking cap, comprising: a cap body having a longitudinal axis; a bore extending partially through the cap body along the longitudinal axis such that the cap body has an opening on a first side and is closed on an opposite second side; an internally threaded portion arranged in the bore at least at the opening. The internally threaded portion is structured and arranged for threaded engagement with a threaded collar of a rotary controller. The bore is structured and arranged to accommodate an output shaft of the rotary controller therein while not contacting the output shaft when the cap body is engaged with the threaded collar. The cap body when engaged with the threaded collar is operable to preclude adjustability of the output shaft of the rotary controller.

In embodiments, the cap body comprises a cylindrical shape.

In further embodiments, the cap body comprises one or more of metal, plastics, and composite materials.

In additional embodiments, the internally threaded portion extends an entire longitudinal length of the bore.

In yet further embodiments, the rotary controller is a potentiometer.

In some embodiments, the rotary controller is a rotary encoder.

Additional aspects of the disclosure are directed to a rotary controller assembly, comprising: a rotary controller having a threaded collar and an output shaft and a rotary controller locking cap in threaded engagement with the threaded collar. The rotary controller locking cap when engaged with the threaded collar is operable to preclude adjustability of the output shaft of the rotary controller.

In embodiments, the rotary controller locking cap, comprises: a cap body having a longitudinal axis, a bore extending partially through the cap body along the longitudinal axis such that the cap body has an opening on a first side and is closed on an opposite second side, and an internally threaded portion arranged in the bore at least at the opening. The internally threaded portion is structured and arranged for threaded engagement with the threaded collar of the rotary controller. The bore is structured and arranged to accommodate the output shaft of the rotary controller therein while not contacting the output shaft when the cap body is engaged with the threaded collar.

In further embodiments, the rotary controller is a potentiometer.

In additional embodiments, the rotary controller is a rotary encoder.

Additional aspects of the disclosure are directed to a rotary controller locking cap retrofit kit for a rotary controller assembly, comprising a rotary controller locking cap engageable with a threaded collar of a rotary controller of the rotary controller assembly, wherein the rotary controller locking cap, when engaged with the threaded collar, is operable to prevent access to an output shaft of the rotary controller so as to preclude adjustability of the output shaft of the rotary controller, and a set of instructions for attaching the rotary controller locking cap to the rotary controller. The set of instructions comprises removing a knob attached to the output shaft of the rotary controller, adjusting the output shaft of the rotary controller to a desired setting, and attaching the rotary controller locking cap to the threaded collar of the rotary controller.

In embodiments, the set of instructions additionally comprises removing a retaining nut from the threaded collar of the rotary controller.

In further embodiments, the set of instructions additionally comprises removing a washer from the threaded collar of the rotary controller.

In additional embodiments, the rotary controller is a potentiometer.

In yet further embodiments, the rotary controller is a rotary encoder.

Additional aspects of the disclosure are directed to a method of disabling adjustability of a rotary controller. The method comprises removing a knob attached to an output shaft of a rotary controller; and attaching a rotary controller locking cap to a threaded collar of the rotary controller, wherein, when attached to the rotary controller, the rotary controller locking cap is operable to prevent access to the output shaft of the rotary controller so as to preclude adjustability of the output shaft of the rotary controller.

In embodiments, the method further comprises removing a retaining nut from the threaded collar of the rotary controller.

In further embodiments, the method further comprises removing a washer from the threaded collar of the rotary controller.

In additional embodiments, the rotary controller is a potentiometer.

In yet further embodiments, the rotary controller is a rotary encoder.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the disclosure. For a more complete understanding of the disclosure, as well as other aims and further features thereof, reference may be had to the following detailed description of the embodiments of the disclosure in conjunction with the following exemplary and non-limiting drawings wherein.

Figure 1:
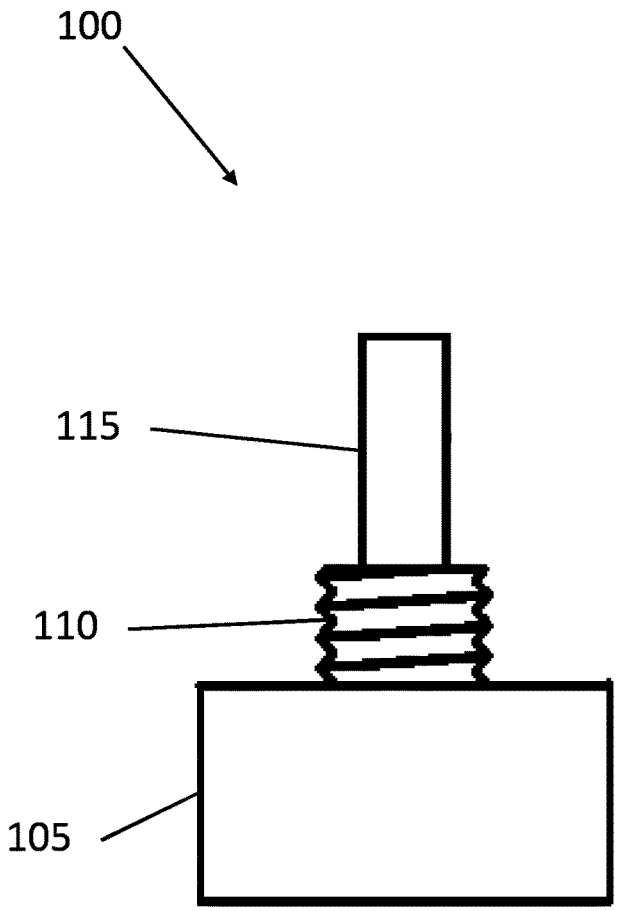
FIG. 1 (Prior Art)
FIG. 1 is side view of a conventional potentiometer.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded. For example, as used herein, the indefinite article "a" indicates one as well as more than one and does not necessarily limit its referent noun to the singular.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of"and "consisting of", so that for instance "a composition comprising a compound A" may also (essentially) consist of the compound A.

The various embodiments disclosed herein can be used separately and in various combinations unless specifically stated to the contrary.

While the specification discusses aspects of the present disclosure with reference to a particular type of rotary controller (a potentiometer), it should be understood that the present disclosure contemplates that the aspects of the disclosure may be used with other types of rotary controllers (e.g., rotary encoders).

FIG. 1 is side view of an exemplary conventional potentiometer 100. As shown in FIG. 1, the potentiometer 100 includes a potentiometer housing 105, a threaded collar 110, and a rotating shaft 115. As should be understood, the potentiometer 100 includes within the potentiometer housing 105, a resistive element, a sliding contact (wiper) that moves along the element, making electrical contacts with one part of it. Electrical terminals (not shown) may be arranged on an exterior of the potentiometer housing 105. The rotating (or output) shaft 115 is structured and arranged to move the wiper from one end of the element to the other, so as to, for example, adjust the level of analog signals present in the various electronic circuits in the device. It should be understood that potentiometer shafts 115 may come in many different configurations, e.g. splined, D-shaped cross-section, hexagonal, or any other polygonal shape.

Figure 2:
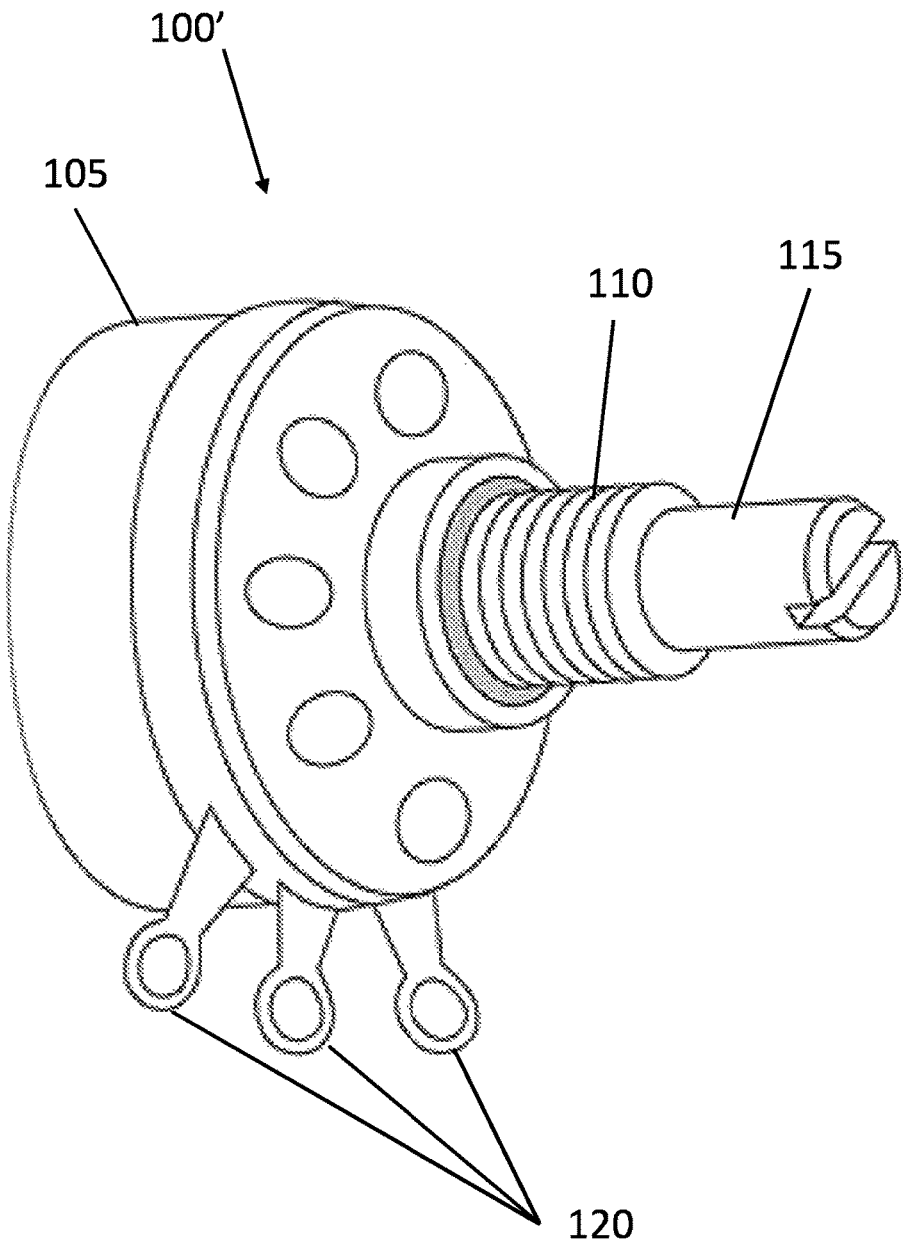
FIG. 2 (Prior Art)
FIG. 2 is a perspective view of a conventional potentiometer.

FIG. 2 is a perspective view of a conventional potentiometer 100'. As shown in FIG. 2, the potentiometer 100' includes a potentiometer housing 105, a threaded collar 110, and a rotating shaft 115. As should be understood, the potentiometer 100 includes within the potentiometer housing 105, a resistive element, a sliding contact (wiper) that moves along the element, making electrical contacts with one part of it. Electrical terminals 120 are arranged on an exterior of the potentiometer housing 105. The rotating (or output) shaft 115 is structured and arranged to move the wiper (or wiper arm) from one end of the element to the other, so as to, for example, adjust the level of analog signals present in the various electronic circuits in the device.

Figure 3:
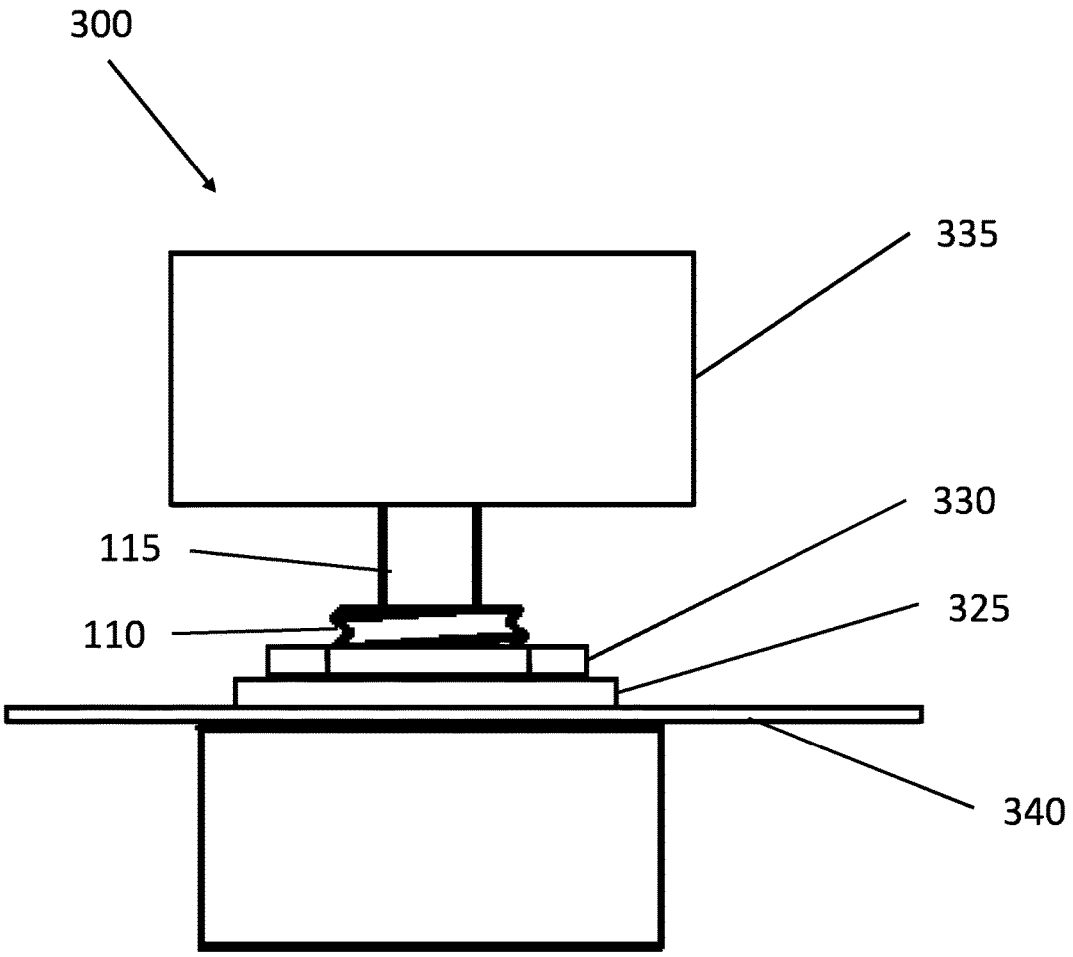
FIG. 3 (Prior Art)
FIG. 3 is side view of a conventional potentiometer assembly having a control knob.

FIG. 3 is side view of a conventional potentiometer assembly 300 having a control knob 335. As should be understood, the control knob 335 is secured to the potentiometer output shaft 115 so as to rotate with the potentiometer output shaft 115. Potentiometers on consumer audio equipment employ knobs 335 to make it easier to adjust the setting of the potentiometer, to allow for indicia or other markings (not shown) to be arranged on the control knob 335 to indicate, for example, setting levels and/or to provide an esthetic element.

As also shown in FIG. 3, the potentiometer assembly 300 may include a retaining nut 330 threadedly fastened to the threaded collar 110 and a washer 325 arranged around the threaded collar 110. The potentiometer assembly 300 may be attached to a housing 340. Without limiting the present disclosure, in embodiments, the housing 340 may be, for example, an instrument housing (e.g., a stringed instrument body), an instrument effect device housing (e.g., a stompbox or rack-mounted effect device housing), a mixer or other audio processing equipment, or an amplification device (e.g., a guitar amplifier). In other contemplated embodiments, the housing 340 may be any housing that accommodates one or more potentiometers.

Figure 4:
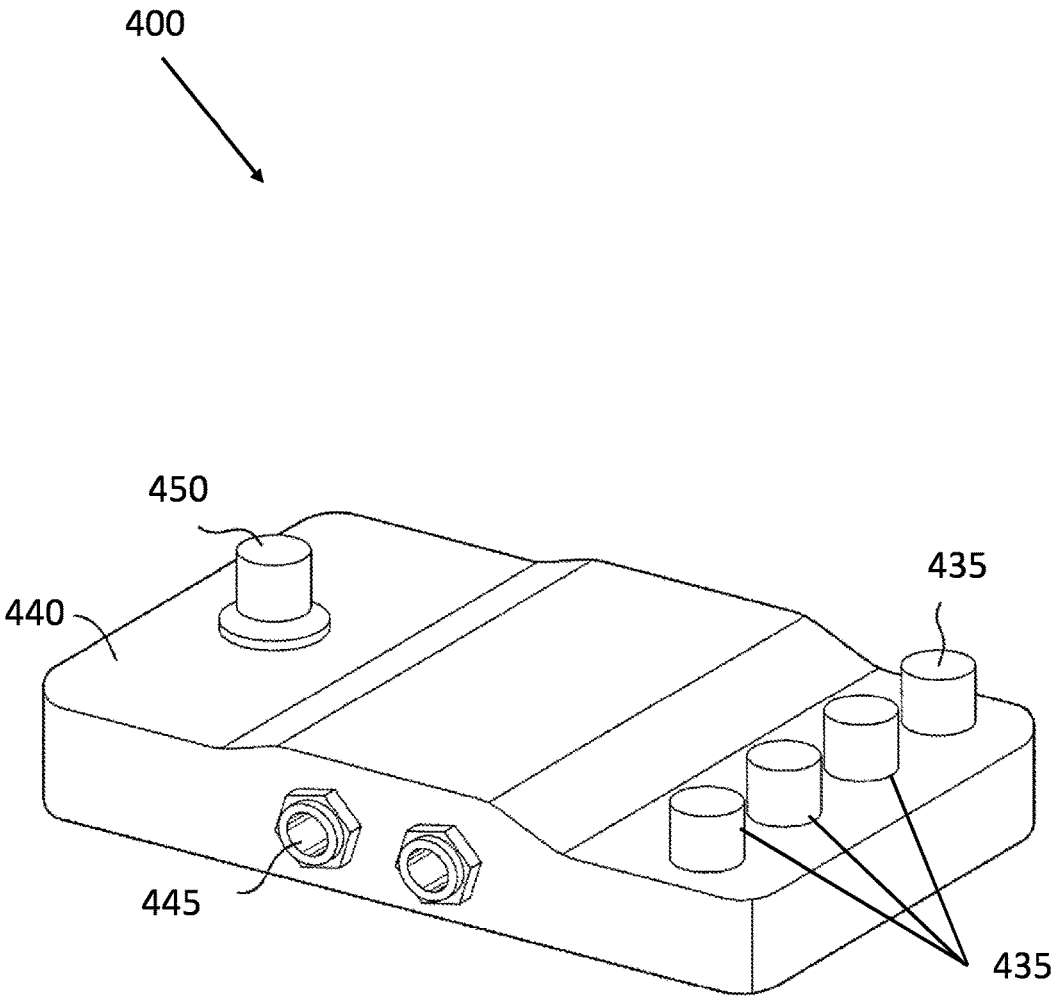
FIG. 4 (Prior Art)
FIG. 4 is perspective view of a conventional "stompbox" effect device having a plurality of potentiometer assemblies with respective control knobs.

FIG. 4 is perspective view of a conventional "stompbox" effect device 400 having a housing 440, and a plurality of potentiometer assemblies (not shown) with respective control knobs 435 arranged on or in the housing 440. As also shown in FIG. 4, the "stompbox" effect device 400 includes a plurality of jacks 445 (e.g., one or more input jacks and one or more output jacks) and an activation switch 450, which selectively activates the circuitry of the "stompbox" effect device 400.

As should be understood, the angular position of the output shaft of each potentiometer may be manually set by a user (e.g., to adjust a particular parameter). Additionally, as shown in FIG. 4, in many applications, a number of potentiometers and their respective control knobs 435 may be arranged on a stompbox 400 in close proximity to one another. When the respective control knobs 435 are arranged in close proximity to one another, a user making an adjustment to one control knob can, for example, inadvertently/unintentionally move another of the control knobs.

Figure 5:
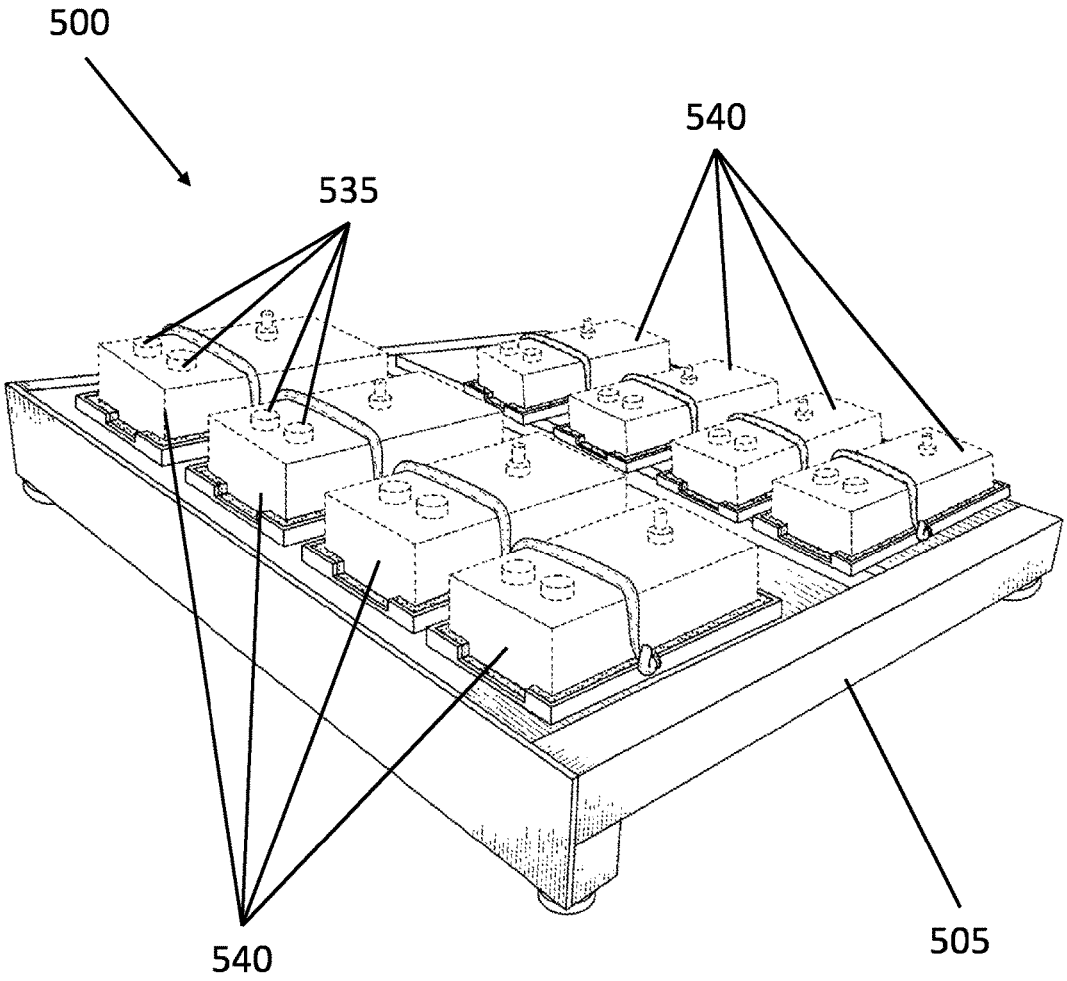
FIG. 5 (Prior Art)
FIG. 5 is perspective view of a conventional pedal board having a plurality of "stompbox" effect devices each having a plurality of potentiometer assemblies with respective control knobs.

FIG. 5 is perspective view of a conventional pedal board assembly 500 including a pedal board 505 and a plurality of "stompbox" effect devices 540 arranged on the pedal board 505. As shown in FIG. 5, each of the plurality of "stompbox" effect devices 540 may have a plurality of respective potentiometer assemblies with respective control knobs 535. As shown in FIG. 5, the plurality of "stompbox" effect devices 540 may be arranged in close proximity to one another. When a plurality of stompbox" effect devices 540 are arranged in close proximity to one another, a user making an adjustment to one control knob 535 of one device 540 may inadvertently/unintentionally move another of the control knobs 535 of the same device or of another device. Additionally, during transportation of audio equipment, e.g., the pedal board 505, to or from rehearsals and/or gigs, one or more of the control knobs 535 may be inadvertently moved, requiring a review of the current settings and possibly a re-setting and/or re-calibration of the equipment each time it is used.

Figure 6:
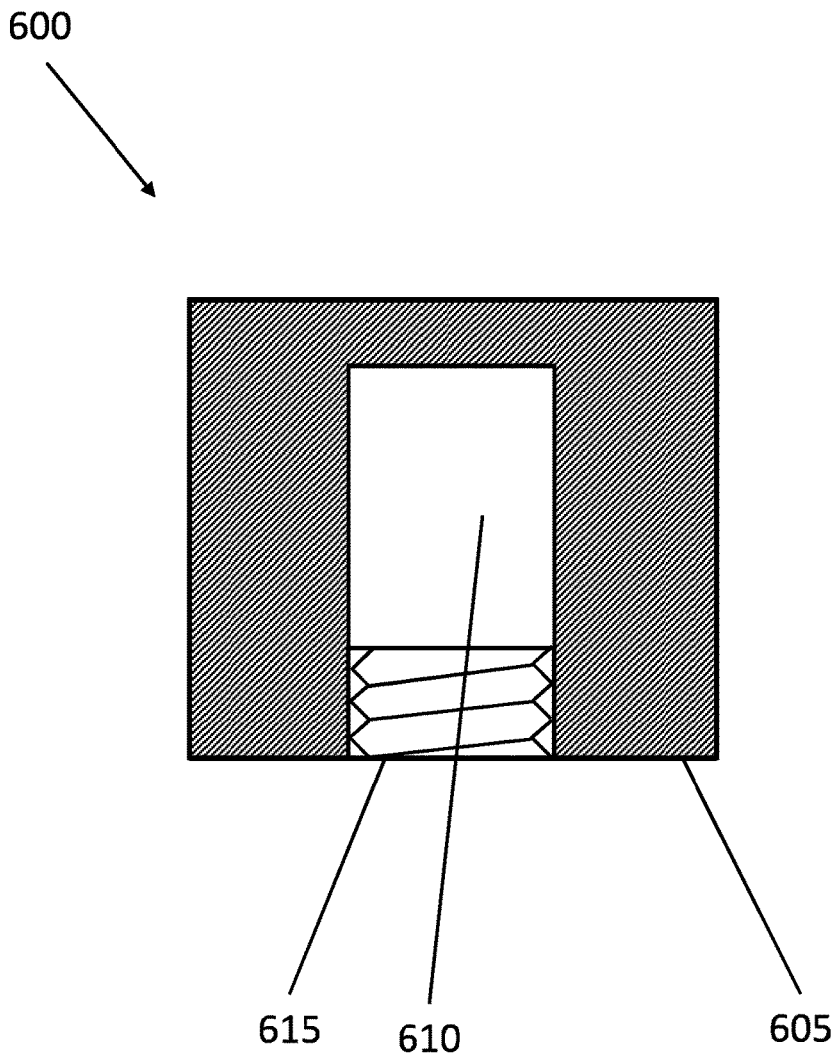
FIG. 6 schematically illustrates a schematic cross-sectional view of an exemplary rotary control locking cap in accordance with aspects of the present disclosure.

FIG. 6 schematically illustrates a cross sectional view of an exemplary rotary control locking cap 600 in accordance with aspects of the present disclosure. As shown in FIG. 6, the exemplary locking cap 600 includes a body 605 with an internal bore 610 formed therein. As shown in FIG. 6, the internal bore 610 does not pass through the locking cap 600, such that the locking cap 600 is closed on an upper (or second) side. The internal bore 610 includes a threaded region 615 having threads that are structured and arranged to engage with a threaded collar (not shown) of a rotary controller (e.g., potentiometer, not shown) so as to secure the locking cap 600 to the potentiometer (not shown). In accordance with aspects of the disclosure, the internal bore 610 is structured and sized so as to provide clearance around a rotary controller output shaft (not shown). In embodiments, the internal bore 610 of the locking cap 600 may be configured for different threaded collar sizes. That is, as different rotary controllers (e.g. potentiometers or rotary encoders) may have different threaded collar diameters, the disclosure contemplates that, in some embodiments, the internal bores may be sized differently to accommodate the differently-sized threaded collars. In embodiments, the internal bore and threaded region may be formed by drilling a hole in the locking cap 600 and then boring the hole to form the threaded region. In some exemplary and non-limiting embodiments, the internal hole may have a diameter of 0.252" and a length of 0.075", which is then bored with an M7 tap with threads formed for 0.65". In other exemplary and non-limiting embodiments, the internal hole may have a diameter of 0.265" and a length of 0.075", which is then bored with an M8 tap with threads formed for 0.65". In other exemplary and non-limiting embodiments, the internal hole may have a diameter of 0.343" and a length of 0.075", which is then bored with a ⅜" tap with threads formed for 0.65". In some exemplary and non-limiting embodiments, the outside diameter of the locking cap 600 may be 0.54". In other exemplary and non-limiting embodiments, the outside diameter of the locking cap 600 may be 0.75".

In embodiments, the locking cap 600 may comprise plastic, metal, composite materials, and combinations thereof. For example, the locking cap 600 may comprise a housing formed of plastic, with a metal threaded region 615 arranged therein. In other embodiments, the locking cap 600 may be formed entirely of metal (e.g., aluminum). Without limiting the present disclosure, in embodiments, depending on materials used, the potentiometer locking cap 600 may be molded, CNC manufactured, die cast, formed with a lathe, and/or 3D printed.

In accordance with aspects of the disclosure, in embodiments the locking cap 600 may have an appearance that mimics the appearance of a conventional control knob. As should be understood, however, in accordance with aspects of the disclosure, when arranged on a potentiometer, the locking cap 600 precludes adjustment (i.e., rotation) of the output shaft of the potentiometer. In such a manner, while the locking cap 600 may have the appearance of a control knob (e.g., an appearance mimicking the appearance of a particular removed control knob), the locking cap 600 does not function as knob (i.e., does not function to rotate the underlying potentiometer output shaft.

Figure 7:
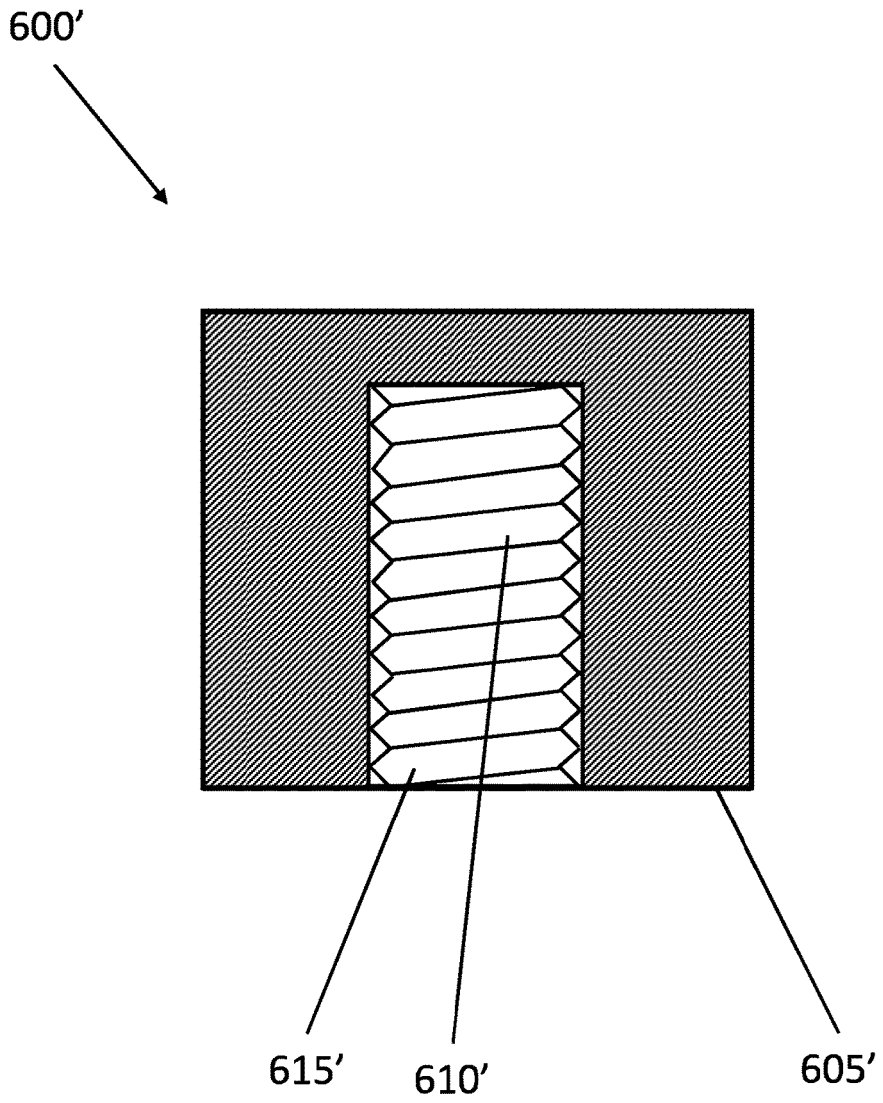
FIG. 7 schematically illustrates a schematic cross-sectional view of another exemplary rotary control locking cap in accordance with aspects of the present disclosure.

FIG. 7 schematically illustrates a cross sectional view of another exemplary locking cap 600' in accordance with aspects of the present disclosure. As shown in FIG. 7, with this exemplary locking cap 600', the threaded region 615 of the internal bore 610' may extend further (e.g., an entire extent) along the length of the internal bore 610'. In accordance with aspects of the disclosure, by providing a threaded region 615 along a greater extent (e.g., an entire extent) of the length of the internal bore 610', the locking cap 600' may be attachable (or more securely attachable) to threaded collars having different (e.g., longer) lengths.

Figure 8A:
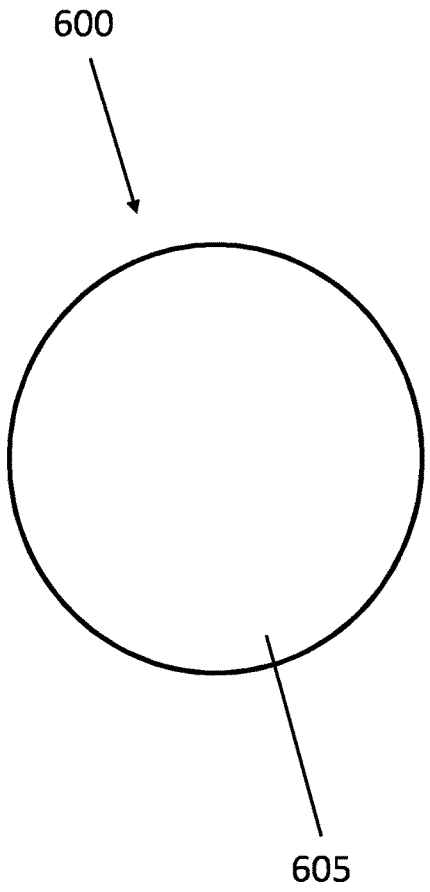
FIGS. 8A and 8B schematically illustrates top and bottom views of an exemplary rotary control locking cap in accordance with aspects of the present disclosure.
Figure 8B:
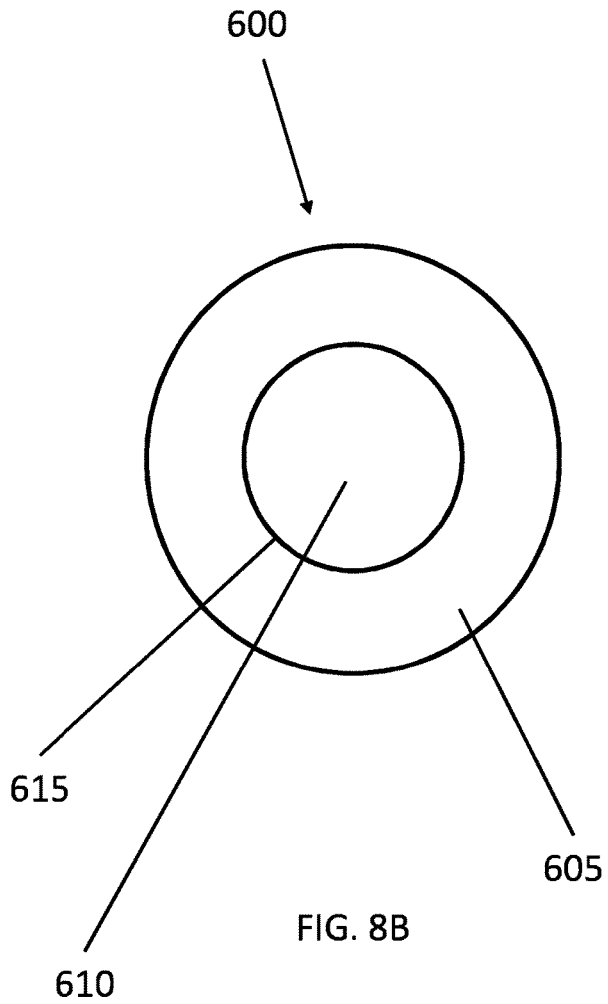

FIGS. 8A and 8B schematically illustrates top and bottom views of an exemplary locking cap 600 in accordance with aspects of the present disclosure. As shown in the top view of FIG. 8A, with this exemplary embodiment, the locking cap 600 is cylindrical in shape and has a body 605 with a circular profile. In accordance with aspects of the disclosure, the locking cap 600 may be cylindrical in shape so as to mimic the shape of a knob. It should be understood, however, that the locking cap 600 need not have a cylindrical shape, and the disclosure contemplates the locking cap 600 may be formed in a variety of shapes while still performing the intended function of preventing access to the potentiometer (or other rotary control) output shaft.

As shown in the bottom view of FIG. 8B, the exemplary locking cap 600 includes a bore 610 formed in the body 605. The bore 610 includes an internally-threaded portion 615 configured for attachment to a threaded collar of a potentiometer (or other rotary control). As noted above, in embodiments, the internal bore 610 of the locking cap 600 may be configured for different threaded collar sizes. That is, as different potentiometers (or other rotary control) may have different threaded collar diameters, the disclosure contemplates that, in some embodiments, the internal bores may be sized differently to accommodate the differently-sized threaded collars.

Figure 9:
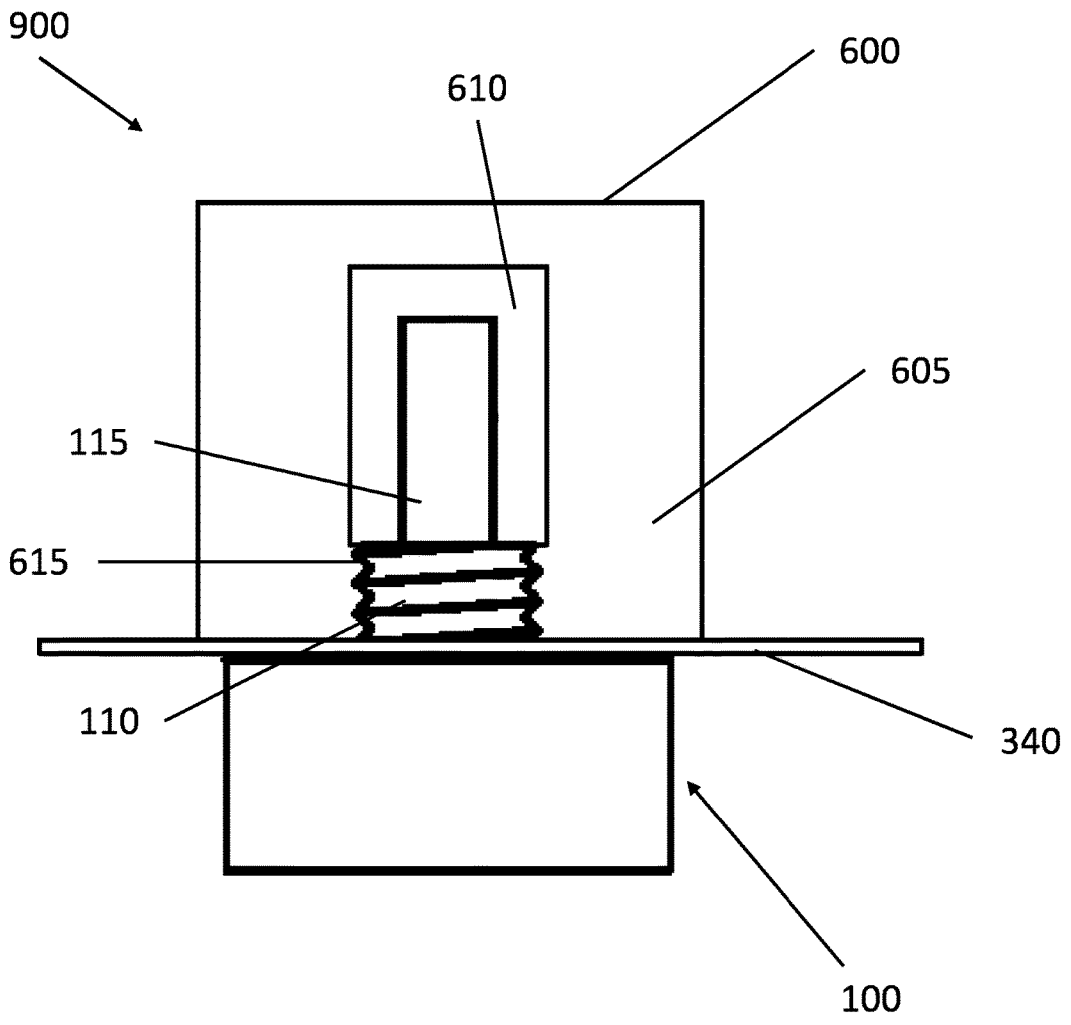
FIG. 9 schematically illustrates a cross sectional view of an exemplary rotary control locking cap arranged on a potentiometer assembly in accordance with aspects of the present disclosure.

FIG. 9 schematically illustrates a cross sectional view of an assembly 900 including an exemplary locking cap 600 arranged on a potentiometer assembly 100 in accordance with aspects of the present disclosure. As noted above, once a desired setting (e.g., rotary or angular position) for a particular parameter is achieved, a user may wish for the angular position of the output shaft to remain in that desired position. For example, "perfected" settings for such knobs (which, of course may be subjective) typically take a long time to achieve. If the position of any potentiometer on any device is moved (for example, amongst a plurality of potentiometers of respective various stompbox devices arranged on a pedal board), the user (or perhaps their roadie or technician) will need to re-set that position to the desired position each in order to attain the desired parameter setting (and, for example, its desired impact on the resulting tone of a musical instrument, e.g., guitar, connected to the effect device). Moreover, if the knobs are moveable, then the setting for each of the knobs need to be checked to ensure they are each positioned as desired.

As shown in FIG. 9, by implementing aspects of the disclosure, once a desired or "perfected" (or even a temporary) setting for a particular potentiometer (or other rotary control) is established, a user may attach locking cap 600 to the threaded collar 110 of the potentiometer 100 in order to prevent further access to the potentiometer output shaft 115. By doing so, any further changes to the potentiometer setting are precluded. In such a manner, in accordance with aspects of the present disclosure, the locking cap 600 effectively disables the adjustability of the potentiometer 100, for example, in order to prevent inadvertent and/or undesired changes to the potentiometer setting.

As shown in FIG. 9, the internally-threaded portion 615 of the potentiometer locking cap 600 is structured and arranged to threadedly engage with the threaded collar 110 of the potentiometer 100. In some embodiments, the locking cap 600 may be screwed onto the threaded collar 110 such that the locking cap 600 is in contact with the housing 340.

In accordance with aspects of the disclosure, as shown in FIG. 9, when the locking cap 600 is arranged on the potentiometer assembly 100, the potentiometer output shaft 115 is located within the bore 610 and is covered by the body 605 of the locking cap 600, such that rotation of the potentiometer output shaft 115 is prevented. In such a manner, in accordance with aspects of the present disclosure, the locking cap 600 effectively disables the adjustability of the potentiometer 100, for example, in order to prevent inadvertent and/or undesired changes to the potentiometer setting.

Thus, for example, once an adjustment of a particular potentiometer has been made, e.g., to achieve a desired sound, a user can utilize a potentiometer locking cap 600 to prevent any further changes to the particular potentiometer. Should a user desire to make adjustments to the potentiometer setting, the user may remove the potentiometer locking cap 600 to expose the potentiometer output shaft 115, and make adjustments thereto. In some applications, for example, on a single effect device, there some potentiometer-controlled parameters that, once set as desired, may not need to change at all or as readily (e.g., drive, tone, and/or mix) and there may be other potentiometer-controlled parameters (e.g., delay time, volume) that may undergo frequent adjustment. In accordance with aspects of the disclosure, locking caps 600 may be utilized to cover those potentiometer output shafts that may not need to be adjusted at all or as readily. In contrast, the potentiometer output shafts of those other potentiometer-controlled parameters that may undergo frequent adjustment may not be covered with locking caps 600, such that the user is readily able to adjust respective potentiometer output shafts (e.g., via respective control knobs).

Figure 10:
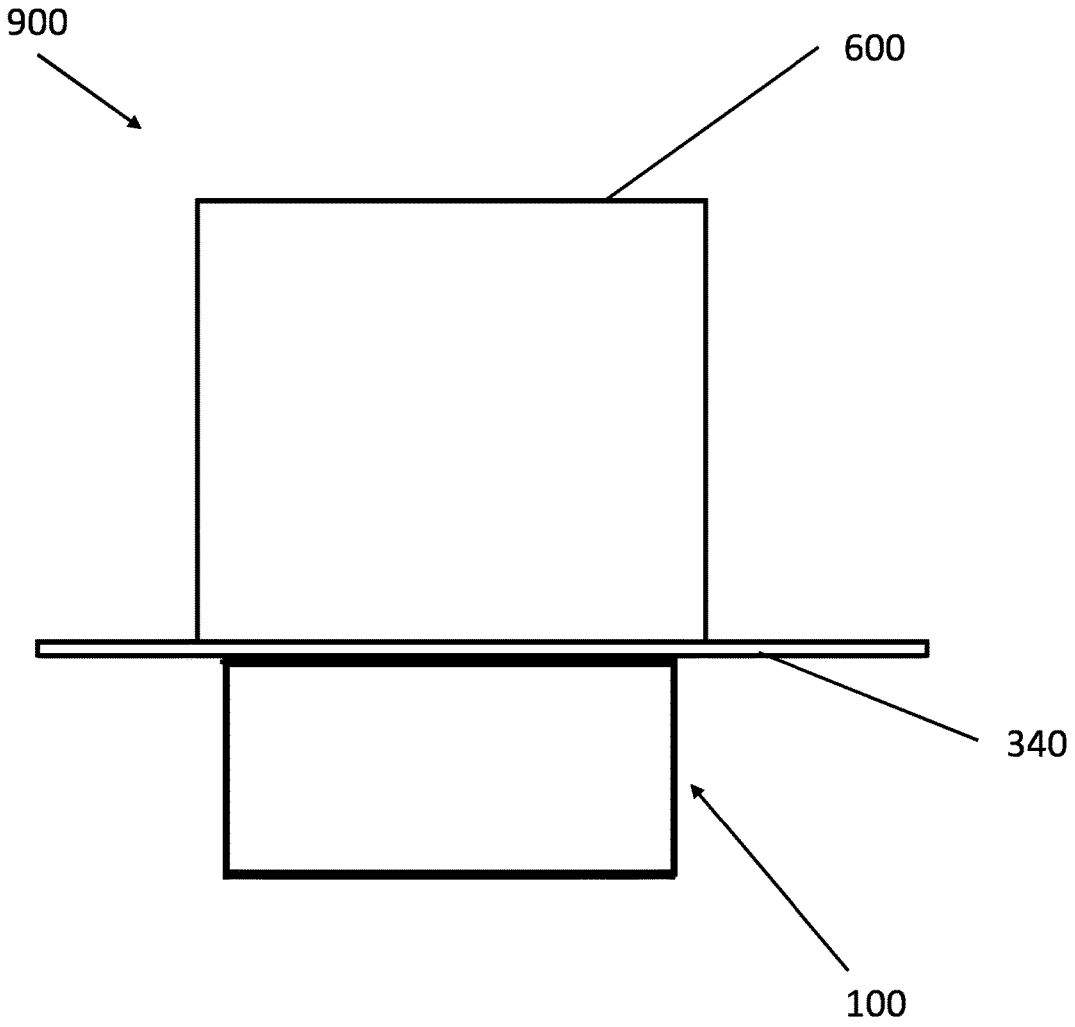
FIG. 10 schematically illustrates an exemplary rotary control locking cap arranged on a potentiometer assembly in accordance with aspects of the present disclosure.

FIG. 10 schematically illustrates an exemplary locking cap 600 arranged on a potentiometer assembly 100 in accordance with aspects of the present disclosure. As shown in FIG. 10, when arranged on the potentiometer assembly 100, the bottom surface of the locking cap 600 may be in contact with the housing 340. Additionally, in accordance with aspects of at least some of the embodiments of the present disclosure, the locking cap 600 may resemble or mimic to some extent, the shape of the control knob. By implementing aspects of the present disclosure, a device having one or more locking caps 600, may appear to have control knobs while not actually having control knobs thereon.

Figure 11:
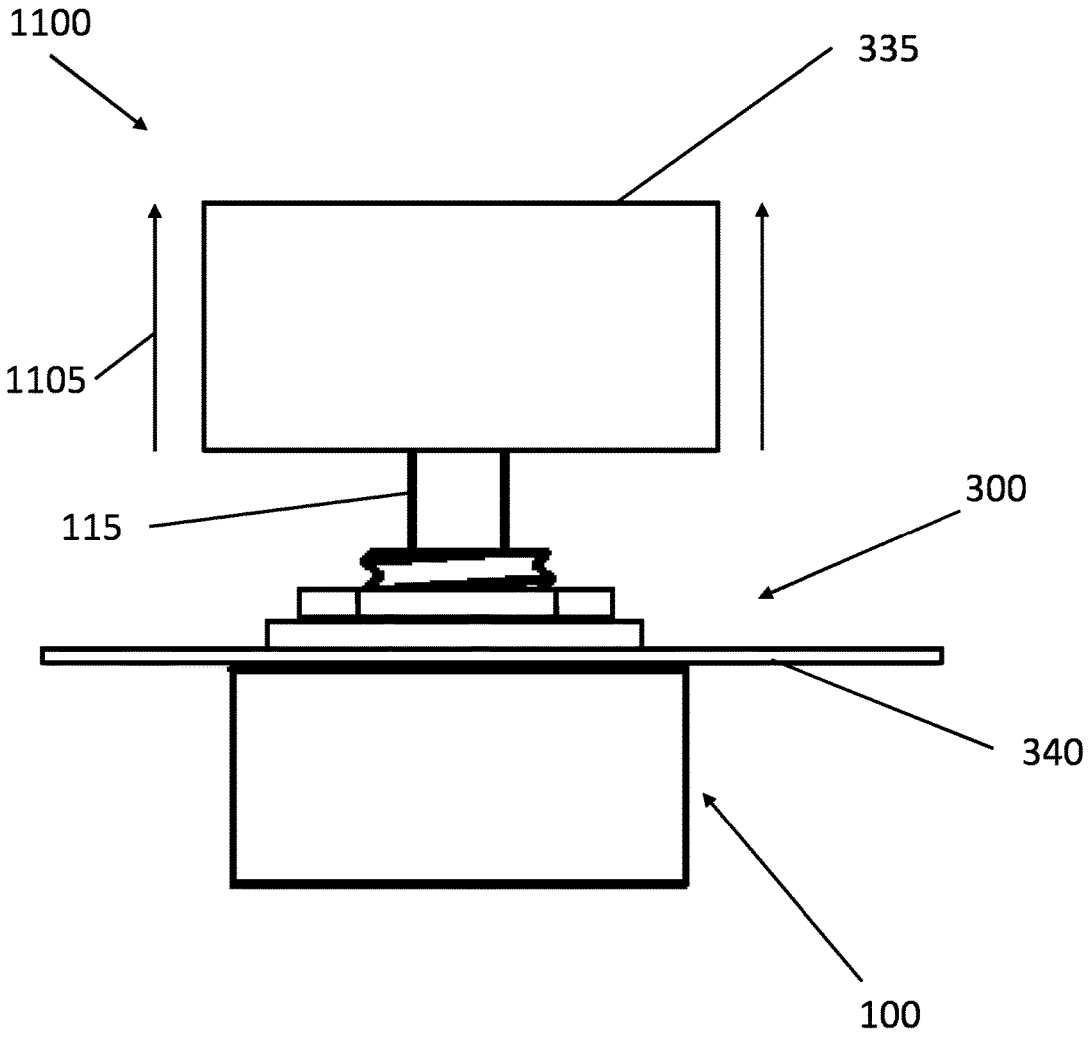
FIG. 11 schematically illustrates removal of a control knob of a potentiometer assembly in accordance with aspects of the present disclosure.

FIGS. 11-15 schematically illustrate process steps 1100-1500 for arrangement of a locking cap 600 on a potentiometer assembly 100 in accordance with aspects of the disclosure. For example, FIG. 11 schematically illustrates a first process step 1100, in which a control knob 335 of a potentiometer (or other rotary control) assembly 300 is removed from the potentiometer output shaft 115 in accordance with aspects of the present disclosure. As shown in FIG. 11, the control knob 335 is moved in direction 1105 to remove the control knob 335 from the potentiometer output shaft 115. As should readily be understood by the ordinarily-skilled artisan, depending on how the control knob 335 is secured to the potentiometer output shaft 115, the removal of the control knob 335 may include additional steps.

Figure 12:
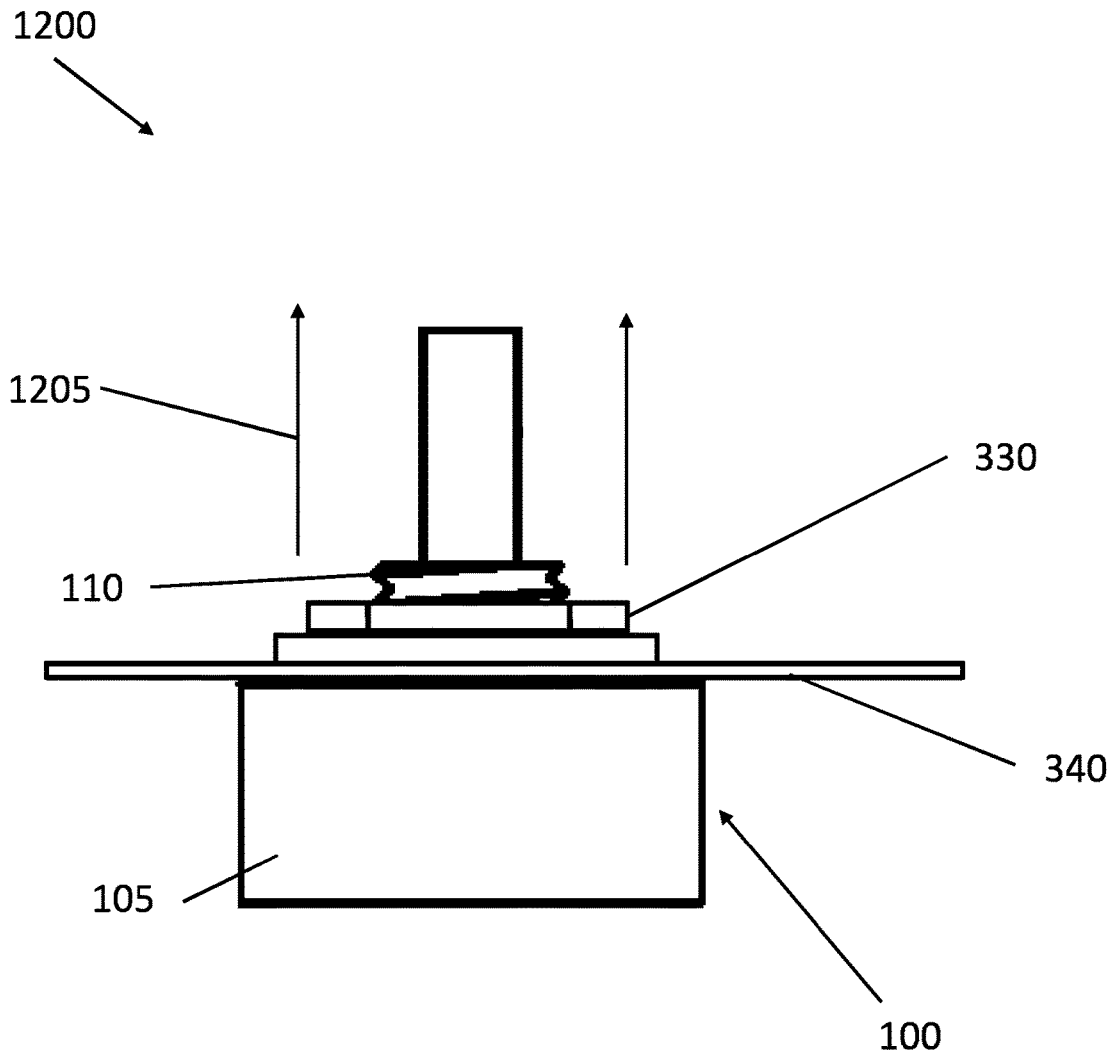
FIG. 12 schematically illustrates removal of a retaining nut of a potentiometer assembly in accordance with aspects of the present disclosure.

FIG. 12 schematically illustrates a second (optional) process step 1200, in which a retaining nut 330 of a potentiometer assembly 100 is removed in accordance with aspects of the present disclosure. As shown in FIG. 12, the retaining nut 330 is threadedly disengaged with the threaded collar 110 so as to be moved in direction 1205 to remove the retaining nut 330 from the threaded collar 110. By removing the retaining nut 330 from the threaded collar 110, a greater extent of the threaded collar 110 may be available to receive the locking cap 600.

In embodiments, it may not be necessary to remove the retaining nut 330 from the threaded collar 110 in order to attach the locking cap 600. That is, the disclosure contemplates that, for example depending upon a length of the threaded collar 110, a locking cap 600 may be secured to the threaded collar 110 while the retaining nut 330 is still arranged on the threaded collar 110. In such contemplated embodiments, the locking cap 600, when threadedly engaged with the threaded collar 110, may not be in contact with the housing 340. That is, the bottom surface of the locking cap 600 may be in contact with the retaining nut 330.

Figure 13:
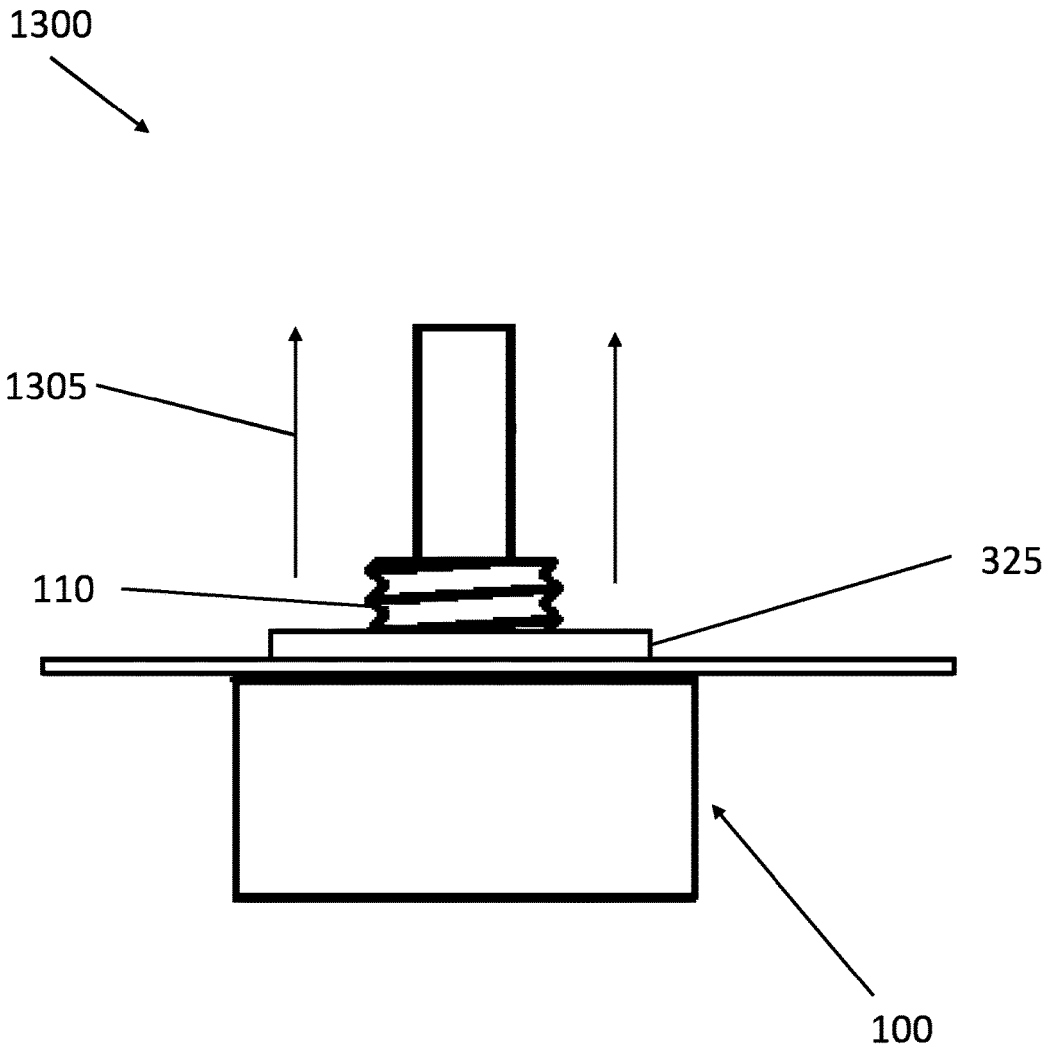
FIG. 13 schematically illustrates removal of a washer of a potentiometer assembly in accordance with aspects of the present disclosure.

FIG. 13 schematically illustrates a third (optional) process step 1300, in which a washer 325 of a potentiometer assembly 100 is removed in accordance with aspects of the present disclosure. As shown in FIG. 13, the washer 325, which is arranged around the threaded collar 110, is moved in direction 1305 to remove the washer 325 from the threaded collar 110. In embodiments, it may not be necessary to remove the washer 325 from the threaded collar 110 in order to attach the locking cap 600. That is, the disclosure contemplates that, for example depending upon a length of the threaded collar 110, a locking cap 600 may be secured to the threaded collar 110 while the washer 325 is still arranged on the threaded collar 110. In such contemplated embodiments, the locking cap 600 may not be in contact with the housing 340. That is, the bottom surface locking cap 600 may be in contact with the washer 325.

Figure 14:
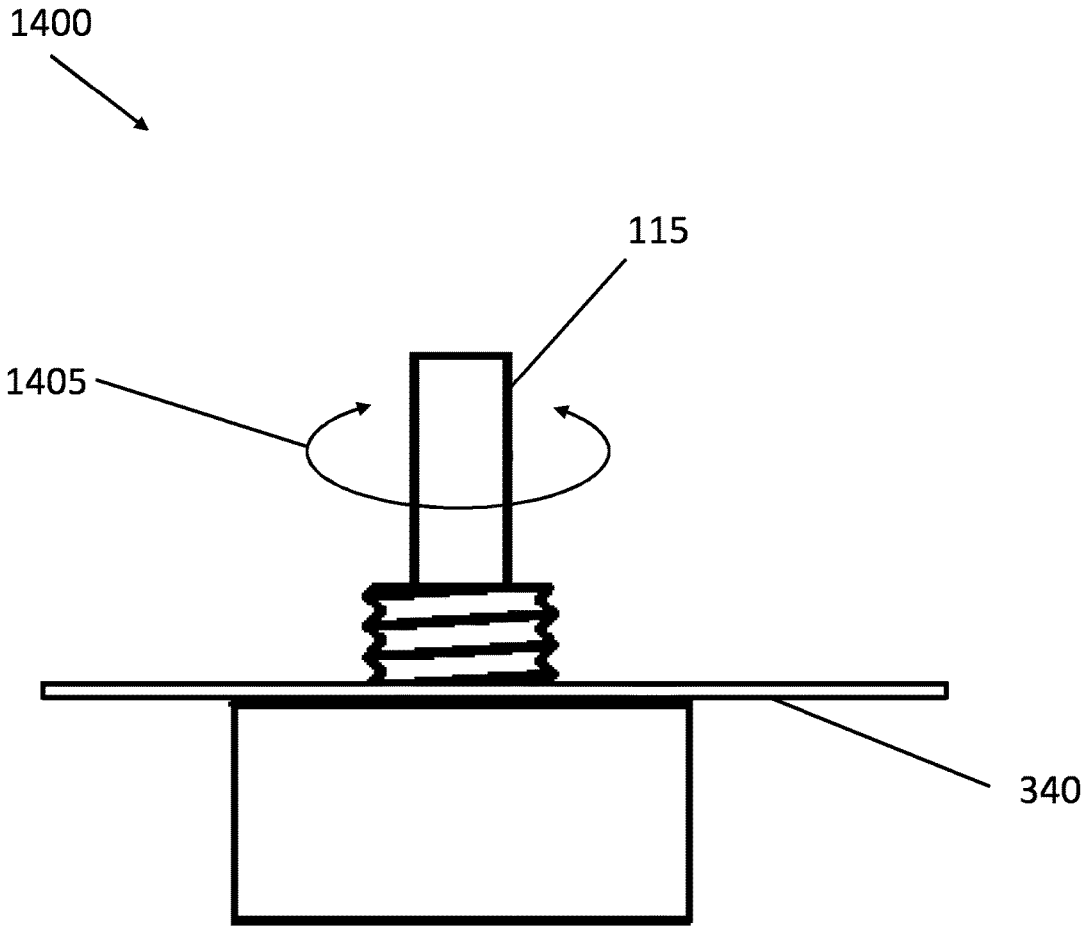
FIG. 14 schematically illustrates adjustment of a potentiometer setting of a potentiometer in accordance with aspects of the present disclosure.

FIG. 14 schematically illustrates a fourth process step 1400, in which a potentiometer setting of a potentiometer 100 is adjusted by rotating the potentiometer output shaft 115 in accordance with aspects of the present disclosure. As shown in FIG. 14, the potentiometer output shaft 115 is moved in direction 1405 to achieve a desired setting for the potentiometer output shaft 115.

Figure 15:
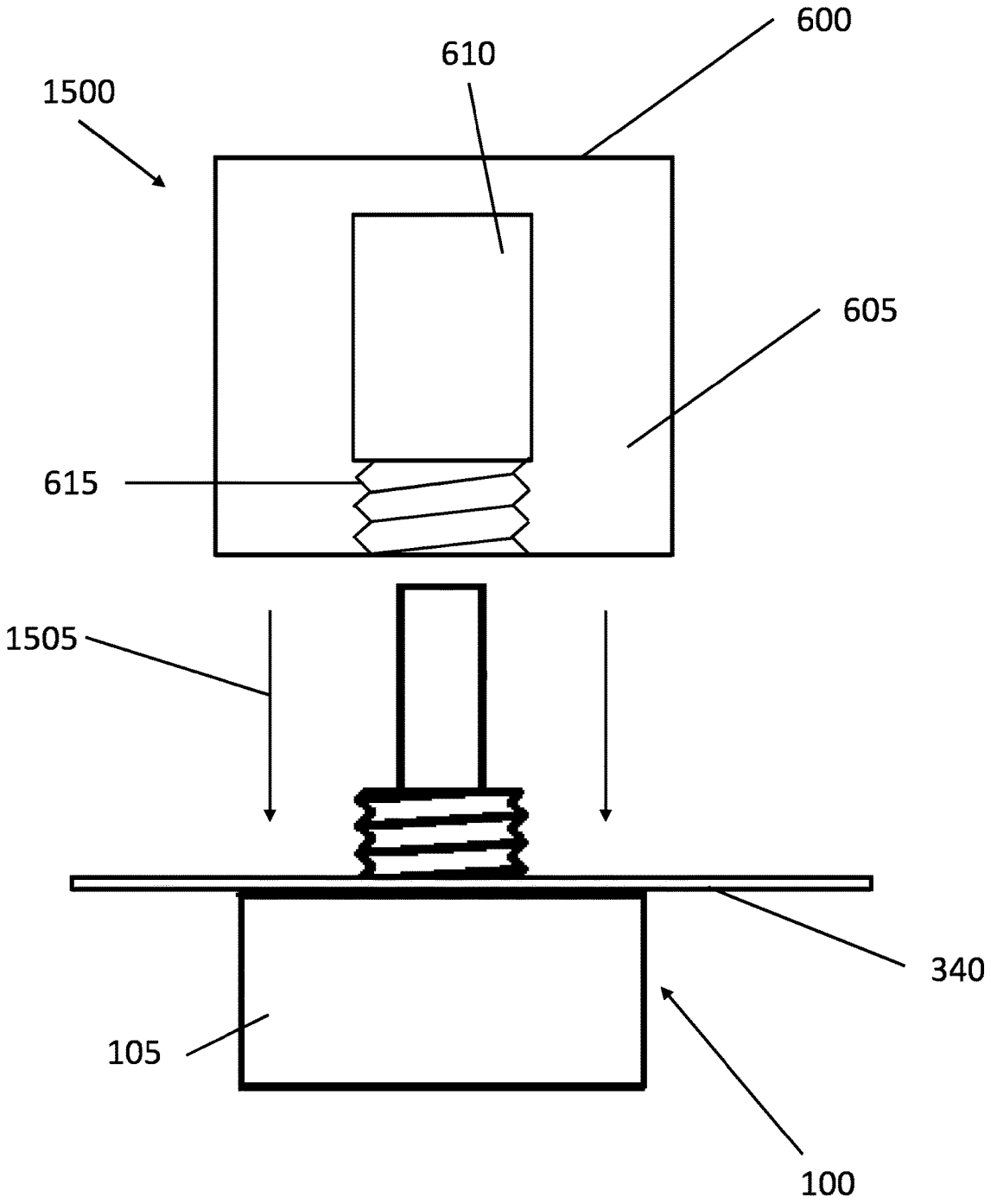
FIG. 15 schematically illustrates the arranging of an exemplary rotary control locking cap on a potentiometer assembly in accordance with aspects of the present disclosure.

FIG. 15 schematically illustrates a fifth process step 1500, in which a locking cap 600 is arranged on a potentiometer assembly 100 in accordance with aspects of the present disclosure. As shown in FIG. 15, the locking cap 600 is threadedly engaged with the threaded collar 110 so as to be moved in direction 1505 to secure the locking cap 600 to the threaded collar 110 of the potentiometer assembly 100. As shown in FIG. 15, in embodiments, the locking cap 600 once fully engaged with the threaded collar 110 may be in contact with the housing 340.

Figure 16:
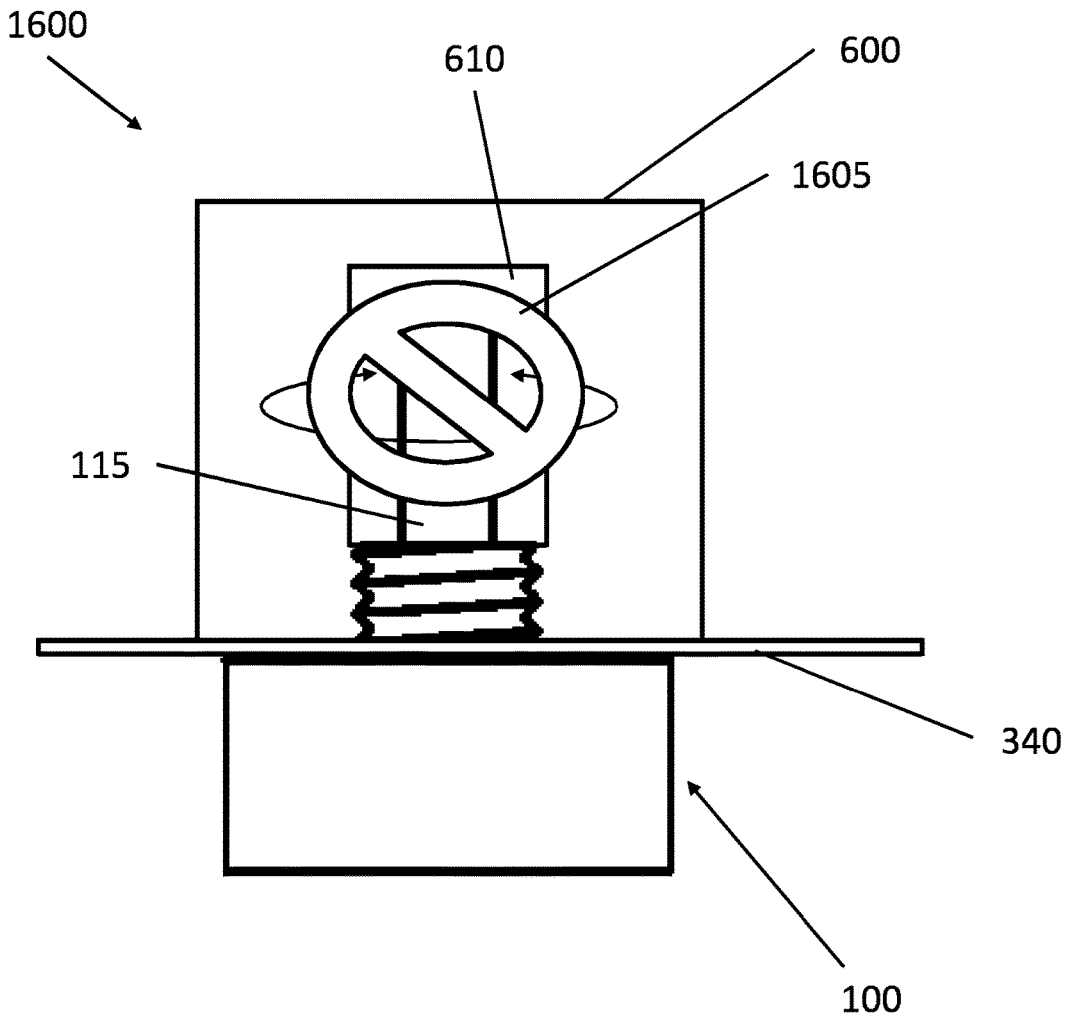
FIG. 16 schematically illustrates that the potentiometer shaft is inaccessible (and un-adjustable) when a rotary control locking cap is arranged on a potentiometer assembly in accordance with aspects of the present disclosure.

FIG. 16 schematically illustrates a "final" arrangement 1600 of a locking cap 600 on the potentiometer assembly 100 in accordance with aspects of the present disclosure. As shown in FIG. 16, when the locking cap 600 is arranged on (or engaged with) the threaded collar 110 of the potentiometer assembly 100, the potentiometer shaft 115 is inaccessible (and un-adjustable). That is, as schematically shown in FIG. 16, the potentiometer shaft 115 cannot be rotated 1605 when a locking cap 600 is arranged on a potentiometer assembly 100.

Figure 17:
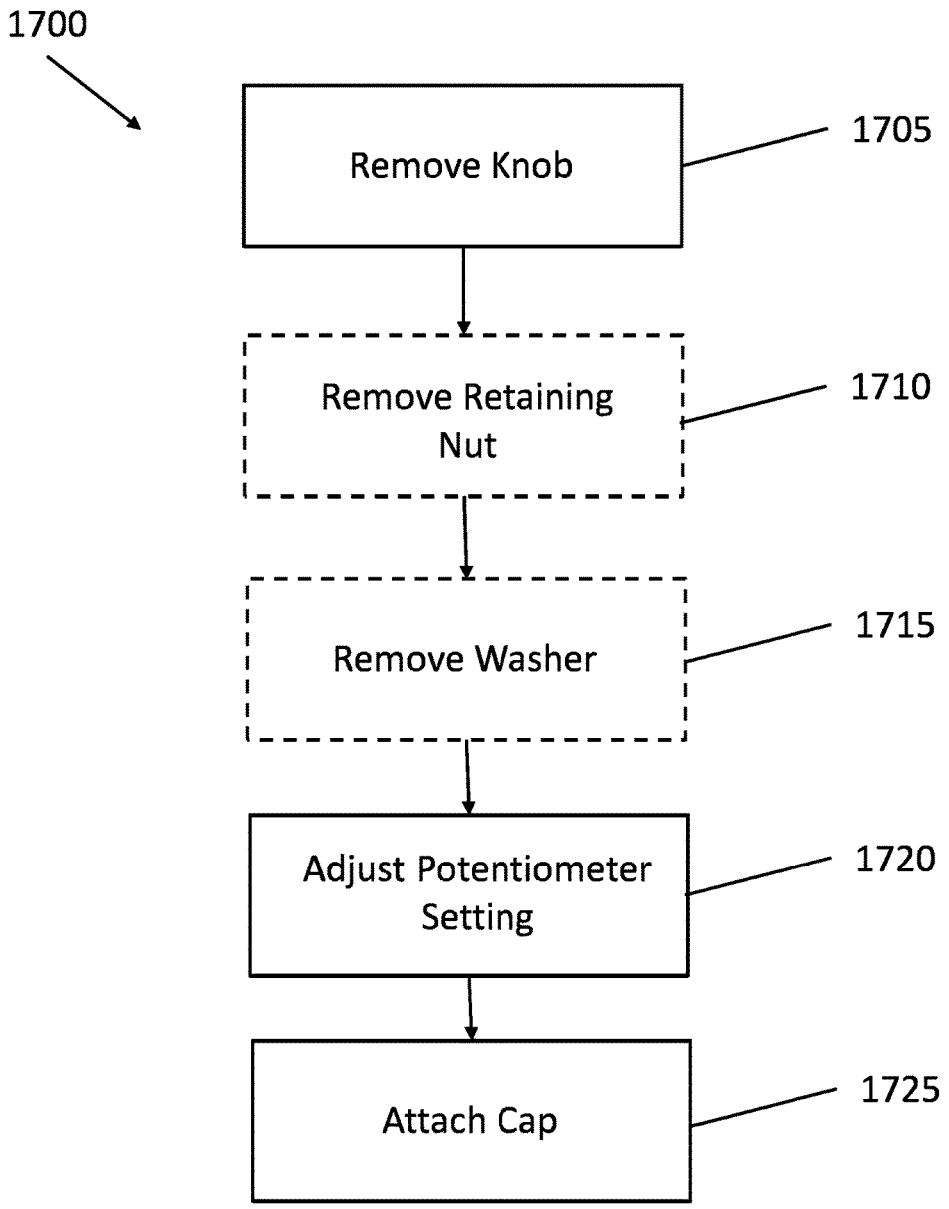
FIG. 17 illustrates an exemplary method for practicing aspects of the present disclosure.

FIG. 17 illustrates an exemplary method for practicing aspects of the present disclosure. As shown in FIG. 17, at step 1705 a user removes a knob from a potentiometer assembly. In embodiments, the knob may be secured to the output shaft of the potentiometer, for example, using a friction fit or a set screw, amongst other attachment techniques. As such, in embodiments, removing the knob may include pulling the knob off of the output shaft of the potentiometer assembly and/or may include removing a set screw securing the knob to the output shaft of the potentiometer assembly.

At optional step 1710 (indicated by the dashed lines), a user removes the retaining nut from the threaded collar of the potentiometer assembly. At optional step 1715 (indicated by the dashed lines), a user removes the washer from the threaded collar of the potentiometer assembly.

At step 1720, a user adjusts a potentiometer setting by rotating the output shaft of the potentiometer. While in this exemplary and non-limiting embodiment, the output shaft of the potentiometer is adjusted after optionally removing the retaining nut and the washer, it should be understood that, in embodiments, step 1720 could occur before removing the retaining nut and the washer (or even before removing the knob). As should be understood, however, the adjusting the potentiometer setting should occur before attachment of the cap to the potentiometer.

At step 1725, a user attaches the locking cap to the threaded collar of the potentiometer (or other rotary controller). In such a manner, in accordance with aspects of the present disclosure, the potentiometer locking cap effectively disables the adjustability of the potentiometer, for example, in order to prevent inadvertent and/or undesired changes to the potentiometer setting.

As should be understood, should a user desire to subsequently make adjustments to the potentiometer setting, the user may remove the locking cap to expose (and render accessible) the output shaft of the potentiometer. Once the output shaft of the potentiometer is accessible, a user may make adjustments to the potentiometer setting, and then re-attach the locking cap.

Furthermore, should a user desire to return the potentiometer assembly to its initial configuration (e.g., with a readily accessible and adjustable control knob), the user may reverse the steps of FIG. 17. That is, a user may, for example, remove the locking cap, replace the washer (if removed), replace the retaining nut (if removed), and reconnect the knob to the output shaft of the potentiometer.

Figure 18:
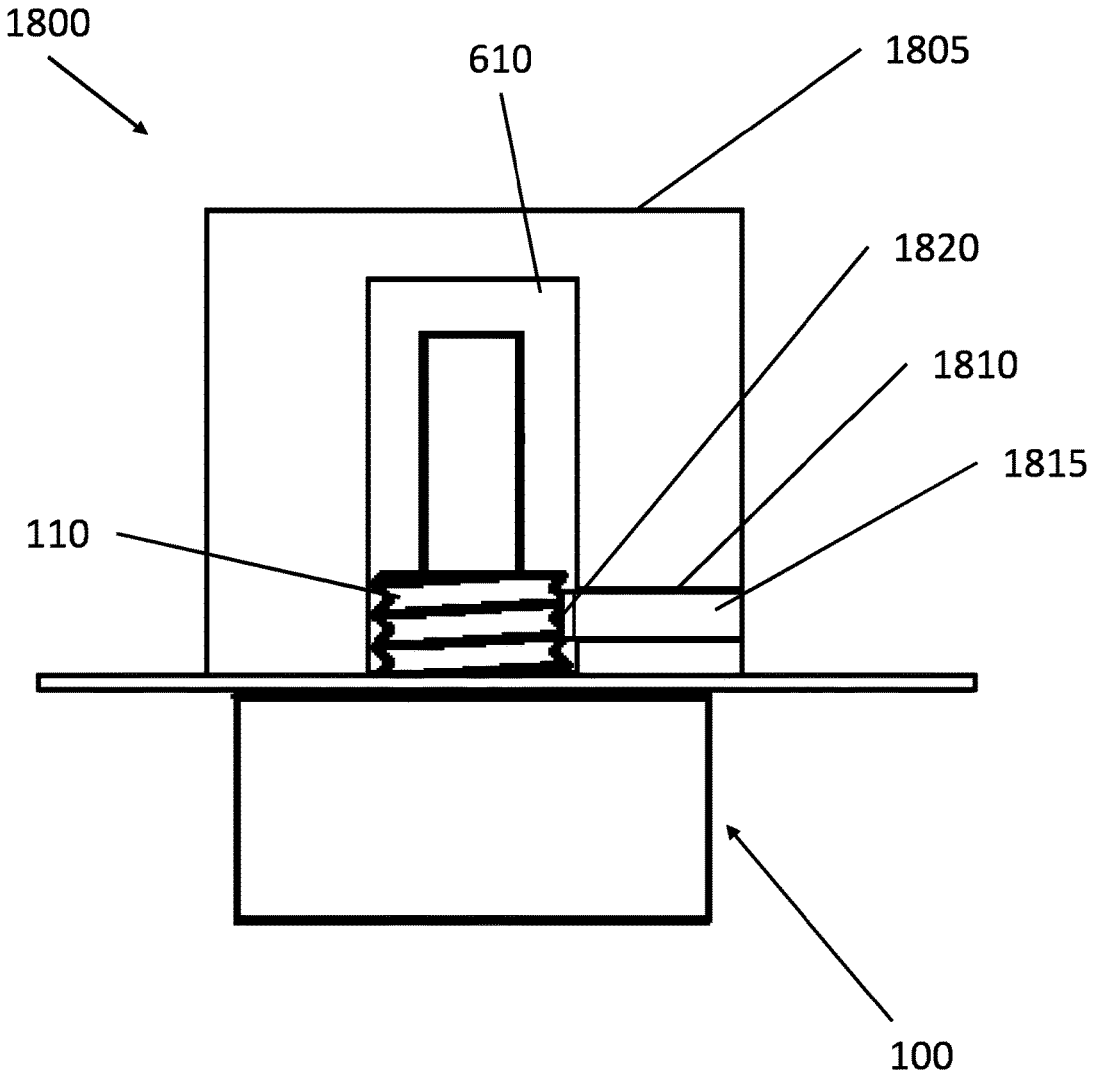
FIG. 18 schematically illustrates an exemplary locking cap 1800 arranged on a potentiometer assembly 100 in accordance with aspects of the present disclosure.

FIG. 18 schematically illustrates an exemplary locking cap 1800 arranged on a potentiometer assembly 100 in accordance with additional aspects of the present disclosure. With this exemplary embodiment, the locking cap 1800 has a cap body 1805 that includes a bore 610. However, with this exemplary embodiment, there are no internal threads arranged in the bore 610 used to secure the locking cap 1800 to the potentiometer assembly 100. Instead, with this exemplary and non-limiting embodiment, the locking cap 1800 includes a set screw hole 1810 arranged approximately perpendicularly to the potentiometer shaft so that a set screw 1815 arranged therein is operable to contact the threaded collar 110 of the potentiometer assembly 100. In such a manner, a user may secure the locking cap 1800 to the potentiometer assembly 100. In some embodiments, as schematically depicted in FIG. 18, the set screw 1815 may include a tip 1820 comprising a compressible material (e.g., rubber), so that when the set screw 1815 is tightened to the threaded collar 110, the set screw 1815 does not damage the threads of the threaded collar 110.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel configuration is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure refers to specific embodiments, those skilled in the art will understand that various changes may be made and equivalents may be substituted for elements thereof without departing from the true spirit and scope of the embodiments of the disclosure. For example, as noted above, while aspects of the disclosure are described with reference to a potentiometer, it should be understood that aspects of the disclosure may be used with other rotary controllers (e.g., rotary encoders). While exemplary embodiments are described above, it is not intended that these embodiments describe all possible forms of the invention. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. A rotary controller locking cap, comprising:

a cap body having a longitudinal axis;

a bore extending partially through the cap body along the longitudinal axis such that the cap body has an opening on a first side and is closed on an opposite second side; and an internally threaded portion arranged in the bore at least at the opening, wherein the internally threaded portion is structured and arranged for threaded engagement with a threaded collar of a rotary controller, wherein the bore is structured and arranged to accommodate an output shaft of the rotary controller therein while not contacting the output shaft when the cap body is engaged with the threaded collar, and wherein the cap body when engaged with the threaded collar is operable to preclude adjustability of the output shaft of the rotary controller.

2. The rotary controller locking cap of claim 1, wherein the cap body comprises a cylindrical shape.

3. The rotary controller locking cap of claim 1, wherein the cap body comprises one or more of metal, plastics, and composite materials.

4. The rotary controller locking cap of claim 1, wherein the internally threaded portion extends an entire longitudinal length of the bore.

5. The rotary controller locking cap of claim 1, wherein the rotary controller is a potentiometer.

6. The rotary controller locking cap of claim 1, wherein the rotary controller is a rotary encoder.

7. A rotary controller assembly, comprising:

a rotary controller having a threaded collar and an output shaft; and a rotary controller locking cap having an internally threaded portion structured and arranged for threaded engagement with the threaded collar, wherein the rotary controller locking cap when engaged with the threaded collar is operable to preclude adjustability of the output shaft of the rotary controller.

8. The rotary controller assembly of claim 7, wherein the rotary controller locking cap, comprises:

a cap body having a longitudinal axis;

a bore extending partially through the cap body along the longitudinal axis such that the cap body has an opening on a first side and is closed on an opposite second side; and the internally threaded portion arranged in the bore at least at the opening, and wherein the bore is structured and arranged to accommodate the output shaft of the rotary controller therein while not contacting the output shaft when the cap body is engaged with the threaded collar.

9. The rotary controller assembly of claim 7, wherein the rotary controller is a potentiometer.

10. The rotary controller assembly of claim 7, wherein the rotary controller is a rotary encoder.

11. A rotary controller locking cap retrofit kit for a rotary controller assembly, comprising a rotary controller locking cap having an internally threaded portion engageable with a threaded collar of a rotary controller of the rotary controller assembly, wherein the rotary controller locking cap, when engaged with the threaded collar, is operable to prevent access to an output shaft of the rotary controller so as to preclude adjustability of the output shaft of the rotary controller, and a set of instructions for attaching the rotary controller locking cap to the rotary controller, the set of instructions comprising:

removing a knob attached to the output shaft of the rotary controller;

adjusting the output shaft of the rotary controller to a desired setting; and attaching the rotary controller locking cap to the threaded collar of the rotary controller.

12. The rotary controller locking cap retrofit kit according to claim 11, wherein the set of instructions additionally comprises removing a retaining nut from the threaded collar of the rotary controller.

13. The rotary controller locking cap retrofit kit according to claim 12, wherein the set of instructions additionally comprises removing a washer from the threaded collar of the rotary controller.

14. The rotary controller locking cap retrofit kit according to claim 11, wherein the rotary controller is a potentiometer.

15. The rotary controller locking cap retrofit kit according to claim 11, wherein the rotary controller is a rotary encoder.

16. A method of disabling adjustability of a rotary controller, the method comprising:

removing a knob attached to an output shaft of a rotary controller; and attaching a rotary controller locking cap having an internally threaded portion structured and arranged for threaded engagement with a threaded collar of the rotary controller to the threaded collar of the rotary controller, wherein, when attached to the rotary controller, the rotary controller locking cap is operable to prevent access to the output shaft of the rotary controller so as to preclude adjustability of the output shaft of the rotary controller.

17. The method of claim 16, further comprising removing a retaining nut from the threaded collar of the rotary controller.

18. The method of claim 17, further comprising removing a washer from the threaded collar of the rotary controller.

19. The method of claim 16, wherein the rotary controller is a potentiometer.

20. The method of claim 16, wherein the rotary controller is a rotary encoder.

* * * * *